United States Patent [19]

Vermeulen et al.

[11] Patent Number: 4,470,176

[45] Date of Patent: Sep. 11, 1984

[54] FASTENING ARRANGEMENT COMPRISING IDENTICAL PAIRS OF FASTENER ELEMENTS

[75] Inventors: Thomas G. Vermeulen, S. Stree, R.D. 1, Box 73, Westmoreland, N.Y. 13490; Roy E. Mullen, Syracuse, N.Y.

[73] Assignee: Thomas G. Vermeulen, Westmoreland, N.Y.

[21] Appl. No.: 429,383

[22] Filed: Sep. 30, 1982

[51] Int. Cl.[3] ..... A44B 11/00

[52] U.S. Cl. ..... 24/163 R; 24/169; 24/265 AL; 24/308; 24/321

[58] Field of Search ..... 24/163 R, 185, 169, 24/321, 308, 318, 265 AL

[56] References Cited

U.S. PATENT DOCUMENTS

| | | | |
|---|---|---|---|
| 77,918 | 5/1868 | Roland | 24/169 |
| 143,668 | 10/1873 | Clark | 24/308 |
| 761,038 | 5/1904 | Edgerton | 24/308 |
| 1,541,701 | 6/1925 | Gaunt | 24/321 |
| 2,260,060 | 10/1941 | Shaulson | 24/318 |
| 2,269,696 | 1/1942 | Shaulson | 24/308 |
| 3,203,067 | 8/1965 | Elsner | 24/265 AL |
| 4,315,350 | 2/1982 | Looker et al. | 24/163 R |

FOREIGN PATENT DOCUMENTS

| | | | |
|---|---|---|---|
| 905206 | 9/1962 | United Kingdom | 24/308 |

*Primary Examiner*—Victor N. Sakran
*Attorney, Agent, or Firm*—Charles S. McGuire

[57] ABSTRACT

A pair of identical fastener elements are arranged in superposed, face-to-face relation to cooperatively define a plurality of elongated, peripherally enclosed channels for passage of end portions of strips of material which are thereby joined by the fastening arrangement. Each element has a plurality of arms extending from a connection at one end with a central body portion to a free end, with opposing, spaced edges of the arms and body portions forming slots closed at one end and open at the other. Placing two of the elements in face-to-face, superposed relation with the arms of each element overlying the opposite end of the arms of the other element provides the peripherally enclosed channels. The fastening elements are disclosed in a number of configurations.

5 Claims, 7 Drawing Figures

FASTENING ARRANGEMENT COMPRISING IDENTICAL PAIRS OF FASTENER ELEMENTS

BACKGROUND OF THE INVENTION

The present invention relates to novel connecting or fastening arrangements for joining end portions of a plurality of strips of flexible material at a common location, and more specifically to a fastening arrangement wherein fastening elements are employed in identical pairs to provide peripherally enclosed channels through which end portions of strip materials are passed for connection to form a composite item.

In many applications it is necessary or desirable, in fabricating a composite article, to join the ends of separate elements such as strips of flexible material by means other than permanent connection of the two elements directly to one another. One example of such applications is the facrication of halters, bridles, and other items of animal harness. Although traditionally made of leather, it is common practice at the present time to employ strips of high-strength, synthetic fabric for such products. Regardless of the material used, however, if end portions of the individual strips of material are permanently joined by stitching, riveting, etc. breakage of one of the strips usually requires replacement of the entire article. Particularly in articles such as halters and bridles where the individual strips are stitched together, it is more inconvenient and expensive to remove and replace a single damaged or broken strip than to acquire an entirely new item.

Accordingly, it is a principle object of the present invention to provide a fastening arrangement for joining end portions of strip materials in the fabrication of composite items which facilitates the replacement of individual strips.

Another object is to provide easily and economically fabricated elements for use in identical pairs as a means of releasably connecting end portions of a plurality of individual strips of flexible material.

Other objects will in part be obvious and will in part appear hereinafter.

SUMMARY OF THE INVENTION

In accordance with the foregoing objects, the invention contemplates a fastening arrangement wherein a pair of identical elements are arranged in superposed, face-to-face relation to form peripherally enclosed, elongated channels through which end portions of flexible materials may be passed, folded back upon and joined to themselves in a closed loop engaging the superposed elements. Each element includes a central body portion having a plurality of arms extending therefrom. The arms are joined at one end to the body portion and have an edge spaced from and preferably parallel to an opposing edge of the body, thereby forming an elongated slot defined by the opposing edges, closed at the end of the arm joined to the body and open at the free end of the arm.

When two such identical elements are placed side-by-side in the same orientation, and one is then turned over upon the other (that is, the two are superposed in "face-to-face" relation) the closed ends of the slots of one element will be superposed with the open ends of the other element. Thus, the two elements define a plurality of peripherally enclosed channels through which end portions of individual strips of material may pass in closed loops to be joined in a desired relationship in forming a composite article such as an animal harness.

These features will be more readily apparent from a consideration of the ensuing detailed description, taken in conjunction with the accompanying drawings.

DETAILED DESCRIPTION

Figure 1:
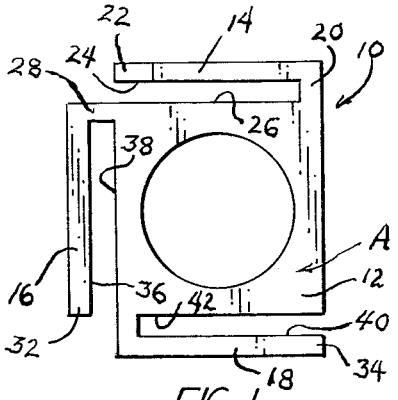
FIG. 1 is a front elevational view of a first embodiment of fastening element of the invention.

Referring now to the drawings, in FIG. 1 is shown a fastening element 10 having central body portion 12 with three arms 14, 16 and 18 extending therefrom. Arm 14 is joined at one end 20 to body portion 12 and extends to free end 22. Between ends 20 and 22, arm 12 has straight edge portion 24 in spaced, parallel, opposing relation to edge portion 26 of body portion 12. Likewise, arms 16 and 18 are joined at ends 28 and 30, respectively, to body portion 12 and extend therefrom to respective free ends 32 and 34. Edge 36 of arm 16 opposed edge 38 of the body portion, and edge 40 of arm 18 opposes edge 42. Arms 14, 16 and 18 are of the same length and extend in the same direction from their joined to free ends about the periphery of body portion 12, i.e., in a counter-clockwise direction in the orientation of FIG. 1.

Figure 2:
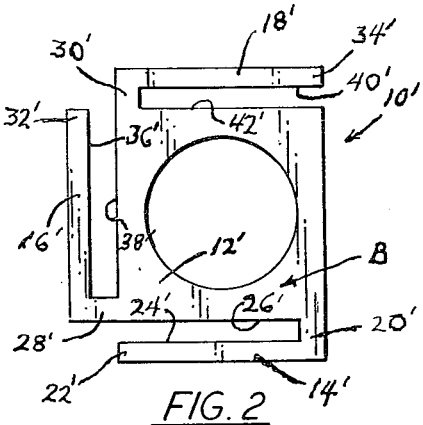
FIG. 2 is a rear elevational view of a fastening element identical to that of FIG. 1, reversed bottom-to-top.

A second fastening element 10', identical to element 10, is shown in FIG. 2. Element 10' includes body portion 12', arms 14', 16' and 18', respectively joined to body portion 12' at ends 20', 28' and 30'. The free ends of the arms are similarly designated by reference numerals 22', 32' and 34', and the edge portions of the arms 24', 36' and 40' oppose edge portions 26', 38' and 42' of body portion 12'. It will be noted that opposite surfaces of elements 10 and 10' are shown and the elements are reversed bottom-to-top that is, the surface designated 'A' of element 10 is seen in FIG. 1 while surface 'B' of element 10' is shown in FIG. 2. Accordingly, the arms extend counter-clockwise about body portion 12, and arm 14 is at the top in the orientation of element 10 shown in FIG. 1, while the arms extend clockwise about body portion 12' and arm 14' is at the bottom in FIG. 2.

Figure 3:
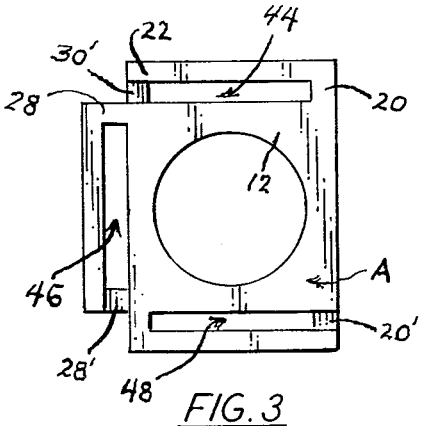
FIG. 3 is an elevational view of the element of FIG. 1 superposed on the element of FIG. 2 in the orientations of each element shown in the preceding Figures.

Elements 10 and 10' are pictured in FIG. 3 in superposed relation with the surface of element 10 which faces downwardly in FIG. 1, i.e., surface 'B', in contact with the upwardly facing surface of element 10' in FIG. 2, also surface 'B'. Thus, the elements may be said to be in face-to-face relation in FIG. 3. In such superposed relation, the elements cooperatively define elongated, peripherally enclosed channels 44, 46 and 48. Channel 44 is closed on one side by end 20 of arm 12, and on the opposite side by end 30′ of arm 18′ with the opposing edges of both arms 12 and 18′ with the respective body portions closing channel 44 along its other two sides. Channels 46 and 48 are peripherally enclosed in the same manner by the superposed portions of the two elements.

Figure 4:
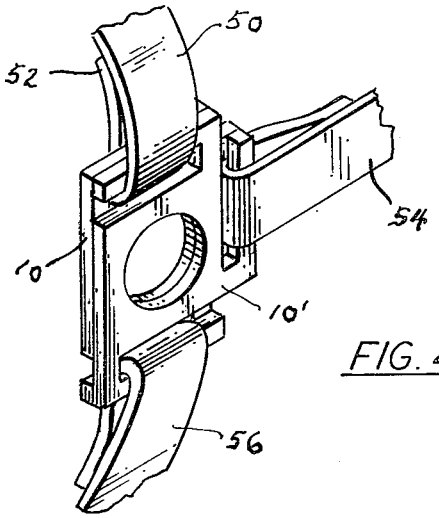
FIG. 4 is a perspective view of the superposed elements of FIG. 3 with fragments of the end portions of a plurality of strips of individual materials joined thereby.

An example of the manner in which the superposed elements are employed to join end portions of separate strips of material is illustrated in FIG. 4. Elements 10 and 10′ are shown in FIG. 4 in an orientation turned over side-to-side from that shown in FIG. 3. Thus, element 10′ is uppermost, with channel 46 being on the right side. Strip 50 passes through channel 44, is folded back upon itself and terminal end 52 is stitched or otherwise attached to the strip, forming a closed loop which engages the fastening arrangement of elements 10 and 10′. In the same manner, closed loops at the ends of strips 54 and 56 pass through and are engaged in channels 46 and 48. Of course, the strips may be passed through the enclosed channels formed by the superposed fastening elements, folded back upon and joined to themselves after the elements are in superposed relation, but more frequently the closed loops will be formed on the ends of the individual strips prior to joining the strips with the fastening arrangement. In such case, the closed end loops of all strips are placed in the slots between the arms and body portion of one of the fastening elements, and the arms of the other fastening element are then rotated into the loops until the two elements are superposed and form the peripherally enclosed channels.

Figure 5:
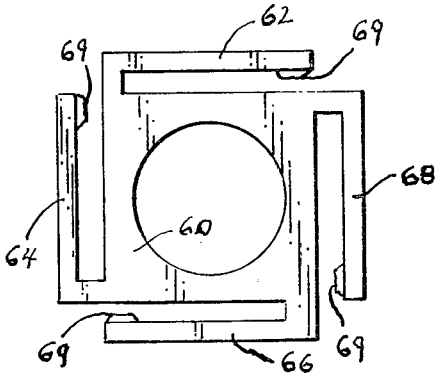
FIG. 5 is an elevational view of a modified construction of the fastening element.

FIG. 5 shows another construction of fastener element 58, having body portion 60 with a total of four arms 62, 64, 66 and 68 extending therefrom. Again, all arms extend from a connected end to a free end in the same direction (i.e., clockwise in the orientation shown) about the perimeter of body portion 60, Fastener elements such as 58 may be used to join the ends of as many as four strips of material at the common location of the element. The number of arms provided, and thus the number of strips which may be joined by the fastener elements may be further expanded, if desired, with the arms evenly spaced about the perimeter of the central body portion or placed at other intervals, depending upon the anticipated application. Also shown in the FIG. 5 construction are tabs 69, extending integrally from the free end of each arm toward the body portion, partially closing the open end of each slot. Such tabs may, of course, be provided in any embodiment of the fastener elements, if desired, to assist in maintaining the strips and fastener elements in assembled relation in the fastening arrangement.

Figure 6:
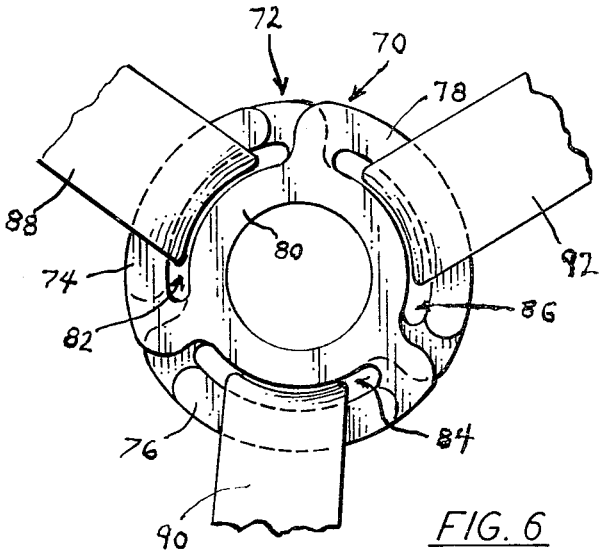
FIG. 6 is an elevational view of another embodiment of a pair of identical, superposed fastening elements, with fragments of strip materials joined thereby.

Fastener elements of circular outline are shown in FIG. 6. However, the constructional principle and operation are the same as that previously described. That is, the elements are employed in identical pairs, in face-to-face relation. As shown in FIG. 6, element 70 overlies element 72. The ends of arms 74, 76 and 78 of element 70 which are joined to body portion 80 thereof overlie the free ends of the arms of element 72 (no reference numbers being applied thereto in the interest of greater clarity), thereby forming peripherally enclosed channels 82, 84 and 86 through which the closed loop ends of strips of material 88, 90 and 92, respectively, pass.

Figure 7:
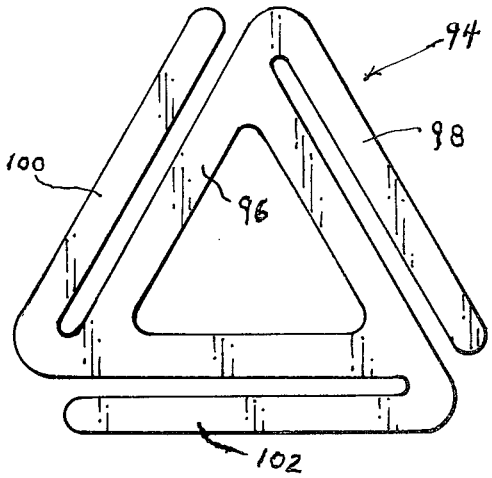
FIG. 7 is an elevational view of still another embodiment of fastening element.

FIG. 7 illustrates yet another construction of fastener element 94, triangular in outline, having central body portion 96 with arms 98, 100 and 102 extending from respective joined ends at the three corners to free ends. Opposed, parallel edges of the body portion and arms form slots open at one end and closed at the other, whereby three peripherally enclosed channels are provided by superposing two identical elements 94 in face-to-face relation, as in the previously described embodiments.

All of the illustrated fastening elements are shown as having body portions of open configuration, i.e., with a central opening therethrough. These openings may be used for other purposes, such as the temporary attachment of items such as hitch or lead lines in the case of halters, and the like. Alternatively, medallions or other items specifically designed for such purpose, may be engaged in the openings. The body portions may also, of course, be of closed configuration, the presence and configuration of the indicated openings being entirely optional.

What is claimed is:

1. A fastening arrangement providing means for joining at a common location the ends of a plurality of elongated strips of material which have been formed in permanently closed loops, said arrangement comprising an identical pair of fastener elements each having:

(a) a central, rigid body including at least three distinct peripheral edge portions;

(b) at least three rigid arms each extending from a connection at one end to said body portion, in the same direction about the periphery thereof, to an opposite, free end with edge portions of said arms in spaced, parallel relation to respective ones of said distinct body edge portions to provide at least three elongated channels closed at said one end and open at said free end of said arms; and (c) said identical pair of fastener elements being superposed one upon the other in face-to-face relation with said arms of the respective elements overlying one another, thereby forming at least three elongated channels closed at one end by the connection of the arms to the body of one of said elements and at the opposite ends by the connection of the arms to the body of the other of said elements, one of said closed loops of said strips of material passing through each of said channels.

2. The invention according to claim 1 wherein said arms are all of substantially the same length.

3. The invention according to claim 2 wherein said body edge portions and said arm edge portions are linear.

4. The invention according to claim 2 wherein said body edge portions and said arm edge portions are arcuate.

5. The invention according to claim 3 wherein said elements are substantially rectangular and said arms extend along three sides thereof.

* * * * *